US007665529B2

(12) United States Patent
Farquhar et al.

(10) Patent No.: US 7,665,529 B2
(45) Date of Patent: Feb. 23, 2010

(54) LUBRICATOR VALVE WITH ROTATIONAL FLIP-FLAP ARM

(75) Inventors: Graham E. Farquhar, Aberdeenshire (GB); David A. Hardie, Inverurie (GB)

(73) Assignee: Baker Hughes Incorporated, Houston, TX (US)

( * ) Notice: Subject to any disclaimer, the term of this patent is extended or adjusted under 35 U.S.C. 154(b) by 471 days.

(21) Appl. No.: 11/604,509

(22) Filed: Nov. 27, 2006

(65) Prior Publication Data

US 2007/0095546 A1 May 3, 2007

Related U.S. Application Data

(63) Continuation-in-part of application No. 11/099,938, filed on Apr. 6, 2005, now Pat. No. 7,270,191.

(51) Int. Cl.
*E21B 34/06* (2006.01)

(52) U.S. Cl. ..... 166/374; 166/321; 166/386

(58) Field of Classification Search ..... 166/321, 166/374, 319, 320, 386
See application file for complete search history.

(56) References Cited

U.S. PATENT DOCUMENTS

| | | | | |
|---|---|---|---|---|
| 4,476,933 | A | 10/1984 | Brooks | 166/324 |
| 4,605,070 | A * | 8/1986 | Morris | 166/380 |
| 4,846,281 | A | 7/1989 | Clary et al. | 166/373 |
| 4,926,945 | A | 5/1990 | Pringle et al. | 166/321 |
| 5,343,955 | A * | 9/1994 | Williams | 166/386 |
| 5,857,523 | A * | 1/1999 | Edwards | 166/374 |
| 6,015,014 | A | 1/2000 | Macleod et al. | 166/374 |
| 6,095,247 | A * | 8/2000 | Streich et al. | 166/299 |
| 6,250,383 | B1 | 6/2001 | Patel | 166/70 |
| 6,457,520 | B2 | 10/2002 | MacKenzie et al. | 166/242.7 |
| 6,644,408 | B2 * | 11/2003 | Ives | 166/332.7 |
| 6,705,593 | B2 | 3/2004 | Deaton | 251/303 |
| 2003/0173091 | A1 | 9/2003 | Horne et al. | 166/386 |
| 2005/0224234 | A1 | 10/2005 | Drummond | 166/386 |

* cited by examiner

*Primary Examiner*—Jennifer H Gay
*Assistant Examiner*—Daniel P Stephenson
(74) *Attorney, Agent, or Firm*—Shawn Hunter

(57) ABSTRACT

An improved lubricator valve arrangement for use within a wellbore to allow the passage of tools, such as perforating guns and the like, into the wellbore while it is live. The inclusion of two, independently controllable flapper-type safety valves within the lubricator valve will permit coordinated testing of fluid pressure both above and below the lubricator valve. The upper flapper valve includes a rotational flip-flap arm arrangement to positively open and close the upper flapper valve. The lower flapper valve is equipped with an integrated poppet-style pressure equalizing valve to allow the lower flapper valve to be opened more easily. The direction of opening of the flapper valves precludes or reduces the risk debris-related problems that might prevent or hinder opening of the flapper valves.

18 Claims, 14 Drawing Sheets

LUBRICATOR VALVE WITH ROTATIONAL FLIP-FLAP ARM

CROSS-REFERENCE TO RELATED APPLICATIONS

This application is a continuation-in-part of U.S. patent application Ser. No. 11/099,938 entitled "Flapper Opening Mechanism" filed Apr. 6, 2005 now U.S. Pat. No. 7,270,191.

BACKGROUND OF THE INVENTION

1. Field of the Invention

The invention relates generally to the design of lubricator valves used for installing tools in a live oil or gas well on wireline while controlling fluids therethrough.

2. Description of the Related Art

During operation of live oil or gas wells, it is sometimes necessary to run a tool, such as a perforating gun, into the well. Because the well is live, it may be under pressure and, therefore, it is necessary to use a device known as a lubricator valve to allow passage of the tool while controlling the flow of pressurized fluid. Sometimes the lubricator valve is located at the surface, above the wellhead. A surface-based lubricator valve is a pressure-retaining container that is used to hold the wireline tool string before it gets deployed downhole. It is often necessary, however, to locate the lubricator valve below the surface of the well. The need to deploy longer logging tools or perforating guns, for example, is a limitation for surface lubricators due to the required height of the lubricator chamber. Applicable safety requirements specify that downhole wireline running arrangements have a minimum of two safety valves (ball or flapper type) to hold the live well pressure. The upper safety valve is closed to pressure test the wellhead pressure from above. The lower safety valve is used to hold pressure from below. The lubricator valve must facilitate pressure testing from both above and below.

Subsurface lubricator valves of various construction are known. U.S. Pat. No. 4,846,281, issued to Clary et al., for example, describes a dual flapper valve apparatus that is used for protecting a well during a gravel packing operation. One problem with this type of arrangement is that the flapper valves close against a valve seat that is located below the flapper valve member. As a result, the flappers open by pivoting upwardly from the closed position. In the event that there is debris atop either flapper member that has accumulated during the pressure testing process, the flapper member(s) may be difficult to open afterward. A further problem with conventional lubricator valves of this type is that the flapper-type safety valves rely solely upon a torsion spring to close the flapper element. If this torsion spring is damaged, the flapper valves within the lubricator valve will fail to close properly.

An additional problem with conventional lubricator valve designs is that there is no bi-directional sealing. When the flapper members are closed, there is no mechanism to secure the flappers in the closed position. Thus, pressure testing can only be accomplished from a single direction as pressurizing the valve in the opposite direction will open the flapper valves. Pressure testing in both directions is important for ensuring the safety of a lubricator valve.

The present invention addresses the problems of the prior art.

SUMMARY OF THE INVENTION

The invention provides an improved lubricator valve arrangement for use within a wellbore to allow the passage of tools, such as perforating guns and the like, into the wellbore while it is live. The inclusion of two, independently controllable flapper-type safety valves within the lubricator valve will permit coordinated testing of fluid pressure both above and below the lubricator valve. The upper flapper valve includes a rotational flip-flap arm arrangement to positively open and close the upper flapper valve. The lower flapper valve is equipped with an integrated poppet-style pressure equalizing valve to allow the lower flapper valve to be opened more easily.

The direction of opening of the flapper valves precludes or reduces the risk debris-related problems that might prevent or hinder opening of the flapper valves. Each of the flapper valves pivots from a closed position to an open position by pivoting in a downward direction away from the valve seat. As a result, any debris that has accumulated on the axial top of the flapper valve element will be dropped off of the flapper element as it opens.

The exemplary lubricator valve also provides a mechanism for positively securing the upper flapper element in a closed position. The flapper member is sandwiched between a flow tube and a closing sleeve, both of which are axially moveable within the lubricator valve, to retain the flapper member in its closed position, thereby allowing bi-directional sealing and testing from both axial sides.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1A:
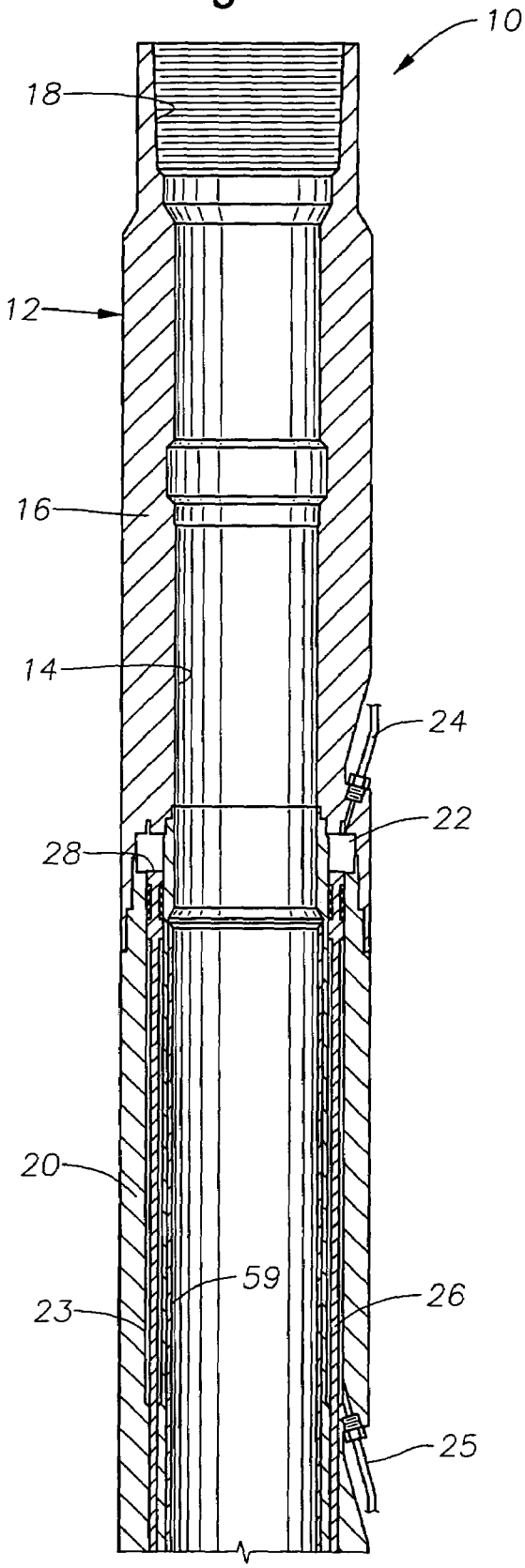
FIGS 1A-1E present a side, cross-sectional view of an exemplary lubricator valve constructed in accordance with the present invention and in an initial open position.
Figure 1B:
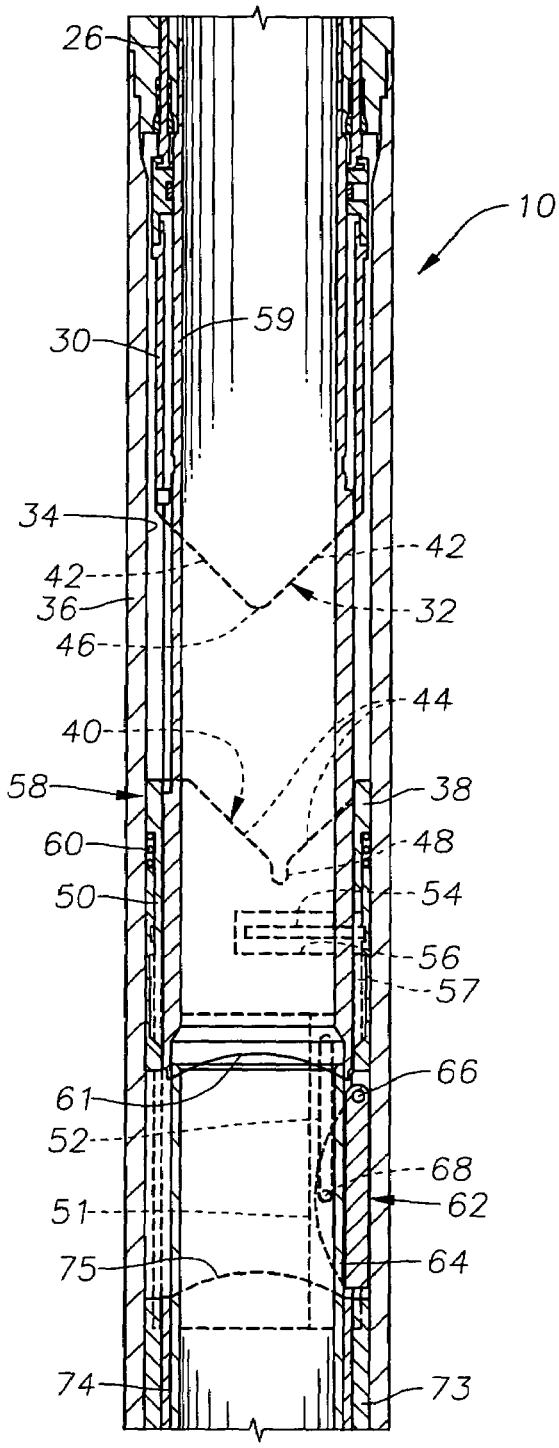
Figure 1C:
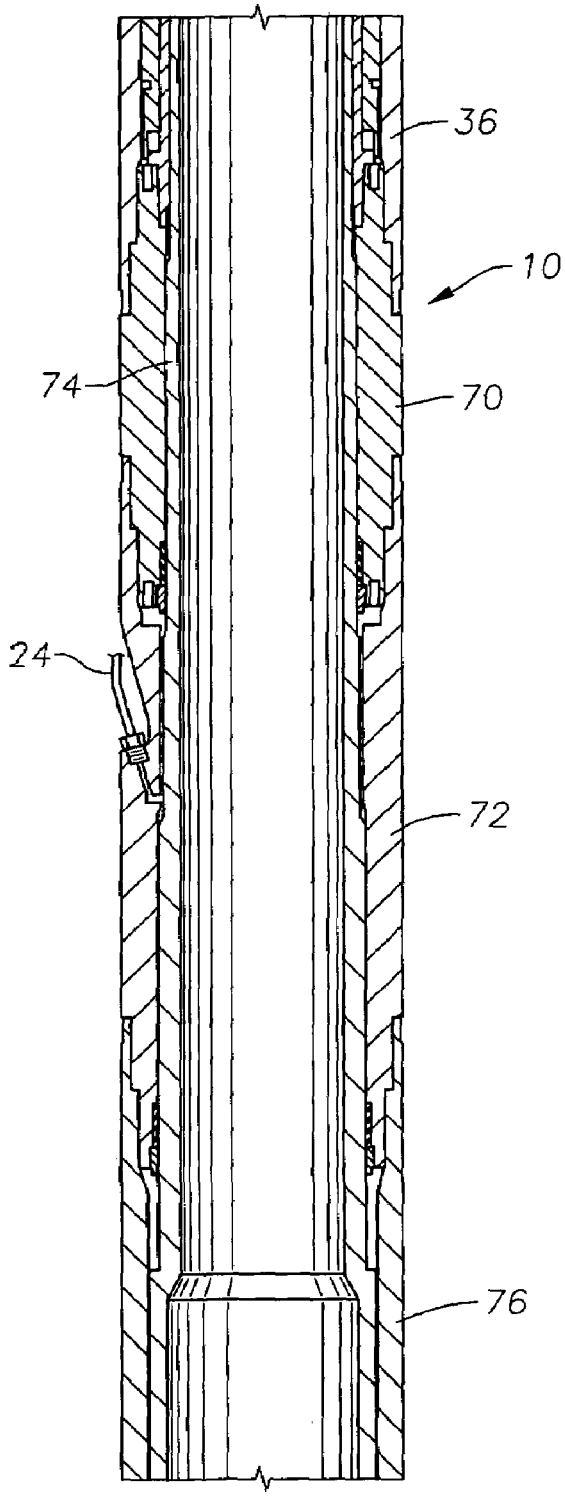
Figure 1D:
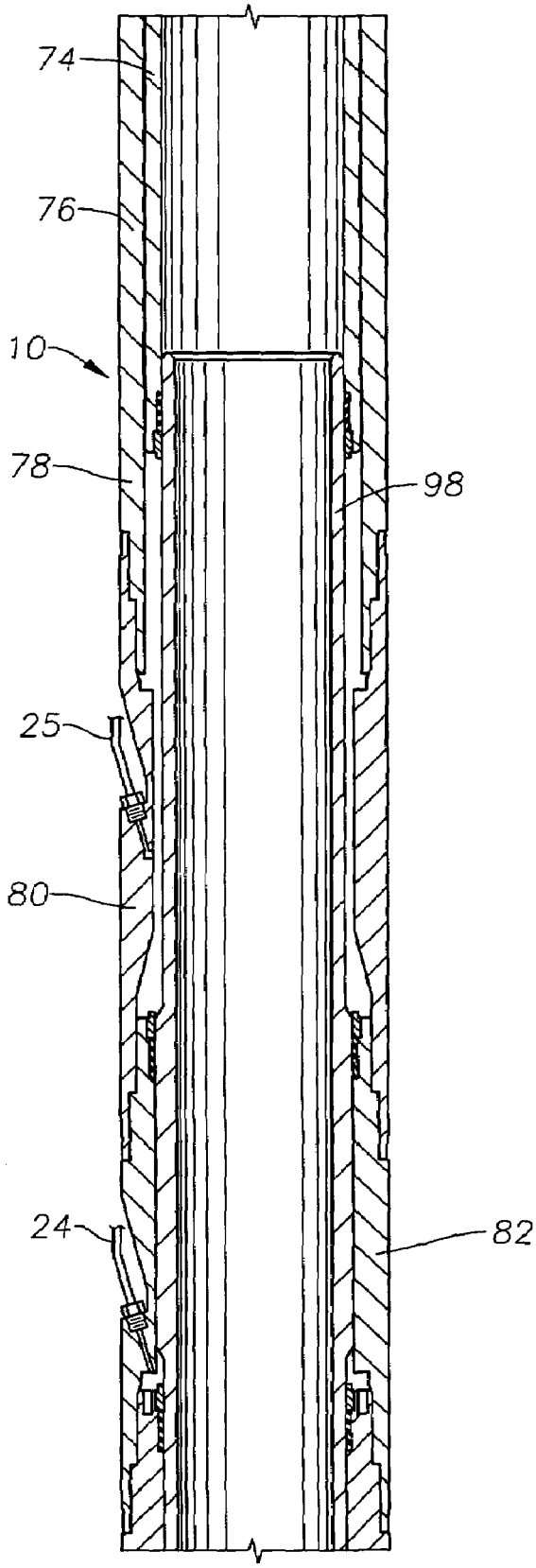
Figure 1E:
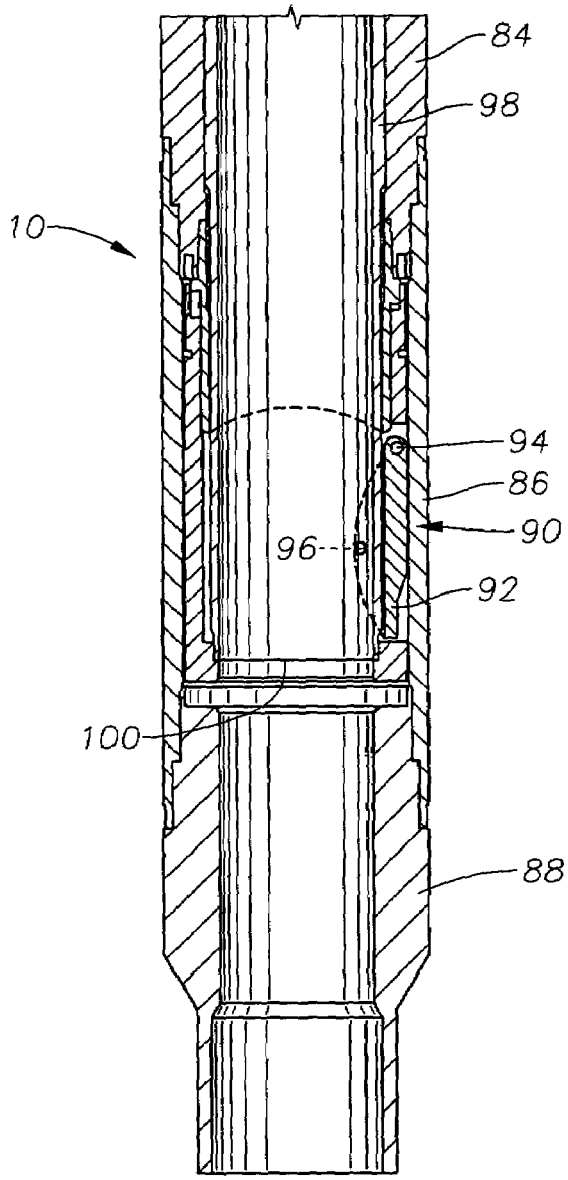

FIGS 1A-1E illustrate an exemplary downhole lubricator valve 10 that is constructed in accordance with the present invention. The valve 10 includes a valve body 12 that defines a flowbore 14 axially therethrough. Beginning at the upper end, shown in FIG. 1A, the valve body or housing 12 has an upper valve nipple 16 with a threaded box-type connection 18. The upper valve nipple 16 is affixed at its lower end to an upper piston sub 20. An annular fluid chamber 22 is defined between the upper valve nipple 16 and the upper piston sub 20. A first hydraulic "open" line 24 runs from a manifold (not shown) into the fluid chamber 22. The fluid chamber 22 is in hydraulic communication with a piston chamber 23 that is defined within the body of the upper piston sub 20. A hydraulic "close" line 25 extends into the lower end of the piston chamber 23. Similar open and close lines 24, 25 will be associated with a lower flapper valve, as will be described shortly.

An annular piston 26 is moveably retained within the piston chamber 23. Selective application of pressure is applied to either of hydraulic lines 24 or 25 to open or close the valve 10. To open the valve 10, the open line 24 would be pressurized and the close line 25 would be opened to drain. To close the valve 10, with the valve 10 being held open by the pressure applied to line 24, a counter pressure is applied to close line 25 and then open line 24 is permitted to drain. The upper end of the piston 26 presents a pressure-receiving area 28. The lower end of the piston 26 is interconnected to a moveable actuation sleeve 30 having an orientation profile 32. The actuation sleeve 30 is disposed within a sleeve passage 34 that is defined within a sleeve housing sub 36. Below the actuation sleeve 30 is an orientation sleeve 38. The orientation sleeve 38 is rotatably disposed within the sleeve passage 34 and includes an axially-directed engagement surface 40 that is shaped and sized to be complimentary to the orientation profile 32 on the actuation sleeve 30. In the embodiment depicted, both the actuation sleeve 30 and the orientation sleeve 38 have sloped side portions 42 (on the actuation sleeve 30) and 44 (on the orientation sleeve 38) that converge to points 46, 48 respectively that are oriented in the downward direction. The orientation sleeve 38 features a tubular sleeve body 50 and a flip-flap arm 51 with a longitudinal slot 52 disposed therein. Additionally, a milled lug 54 extends radially inwardly into slot 56 in a surrounding upper hinge support 57. The upper end of the orientation sleeve 38 presents a radially enlarged portion 58 that is located above a torsion spring 60. The torsion spring 60 resists-radial rotation of the orientation sleeve 38 within the surrounding sleeve housing sub 36. An upper closure sleeve 59 resides radially within the sleeve housing sub 36. The closure sleeve 59 presents a lower end 61 that is sinusoidally shaped and sized to abut the upper axial side of the flapper member 64 of the upper flapper-type safety valve 62 in a flush mating relation when said flapper member 64 is in a closed position. The upper closure sleeve 59 is axially moveable within the sleeve housing sub 36 under the impetus of hydraulic fluid injected through hydraulic inlets 24, as is known in the art. The upper closure sleeve 59 returns to its original position by application of hydraulic fluid. Meanwhile, the torsion spring 60 allows rotation of the flip-flap arm 51 during reopening, and this is done after the closure sleeve 59 has moved upwardly.

Located below the orientation sleeve 38 is an upper flapper-type safety valve 62 that is moveable between an open position (shown in FIG. 1B) and a closed position (shown in FIG. 3B). The valve 62 has a flapper member 64 that affixed by a hinge 66 to the surrounding upper hinge support 57. The flapper member 64 will close against sinusoidal valve seat 61 to create a fluid seal within the valve 62. It is noted that, when opening, the flapper member 64 will pivot downwardly away from the valve seat 61. This feature is valuable since it allows debris that may have collected atop the flapper member 64 to fall downwardly rather than to block opening of the flapper member 64. In addition, the flapper member 64 has an outwardly projecting pin 68 on at least one radial side. The pin 68 extends into the slot 52. During run-in, the orientation sleeve 38 is initially positioned (see FIG. 1B) so that the point 48 of the engagement surface 40 is rotationally offset from the point 46 of the actuation sleeve 30.

Figure 8:
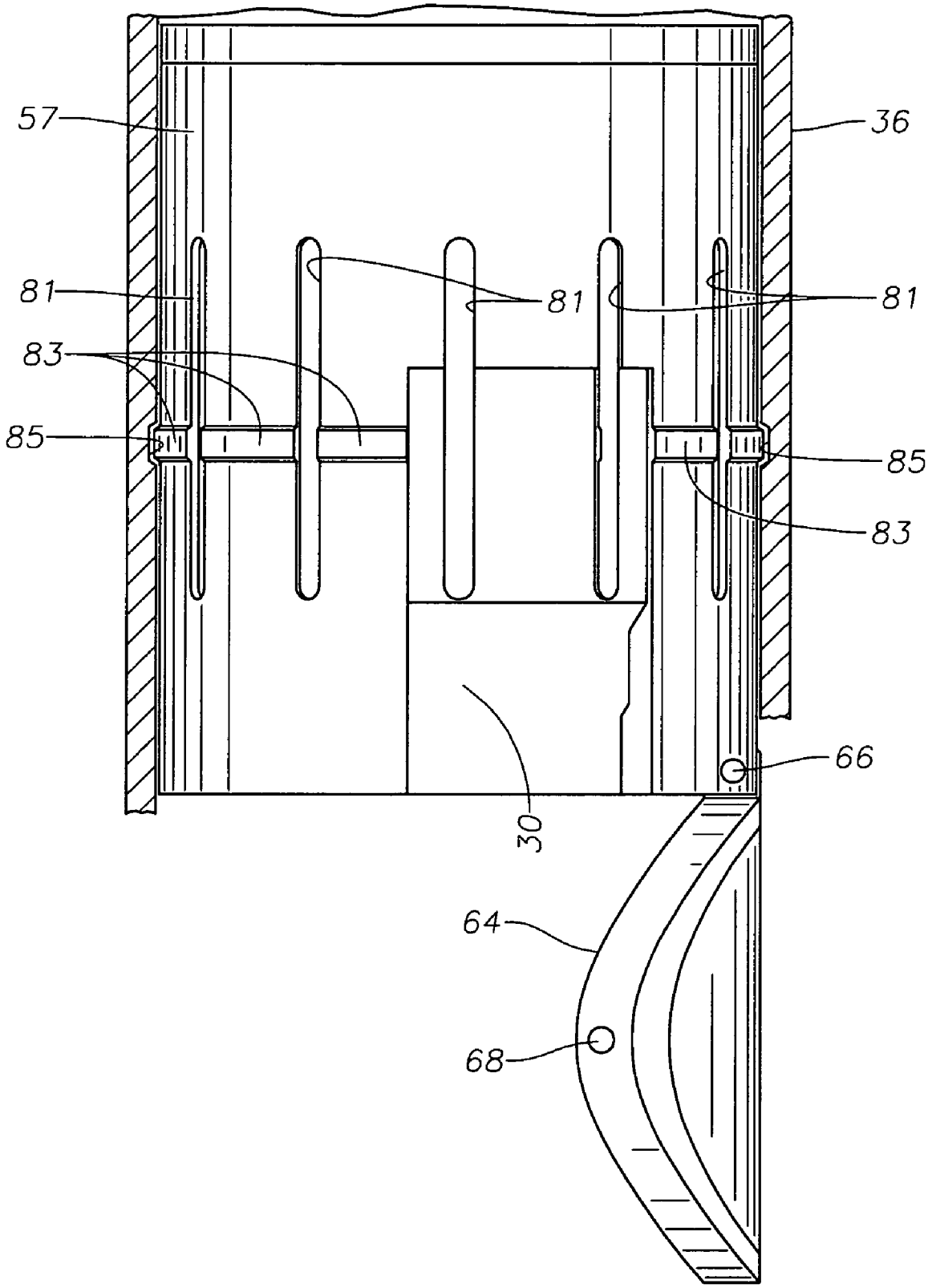
FIG. 8 is a side cut-away view of portions of the upper flapper valve portion of the lubricator valve.

As best shown in FIG. 8, there is a reversible collet interconnection between the upper hinge support 57 and the surrounding sleeve housing sub 36. The body of the hinge support 57 contains a plurality of axial slots 81 that are axially distributed about the circumference of the hinge support 57. Raised collet ridges 83 are disposed upon the outer radial surface of the hinge support 57. The collet ridges 83 are shaped and sized to reside within enlarged groove 85 in the housing sub 36. This collet interconnection is useful for preventing any axial movement of the upper flapper member 64 with respect to the surrounding sleeve housing sub 36 during rotational closure of the upper safety valve 62. Engagement of the collet ridges 83 within the groove 85 releasably secures the hinge support 57 and housing sub 36 together. During rotational closure of the flapper member 64 of the upper safety valve 62, it is important that the flapper member 64 be moved to the closed position without axial movement. Once closed, however, additional pressure in the open line 24 acting upon the pressure receiving area 28 of the piston 26 will cause the portions of the body of hinge support 57 to deflect radially inwardly, thereby allowing the collet ridges 83 to become released from the groove 85 and permits the hinge support 57 to move axially with respect to the housing sub 36.

The lower end of the sleeve housing sub 36 is affixed to an upper connector sub 70 which is, in turn, connected to a lower connector sub 72. An upper flow tube 74 resides radially within the sleeve housing sub 36 and the connector subs 70, 72. The upper flow tube 74 is axially moveable within the sleeve housing sub 36 and connector subs 70, 72 for controlled operation of the flapper member 64 of the upper safety valve 62. Movement of the upper flow tube 74 is accomplished by selective injection of fluid via various hydraulic lines 24. As such actuation is well known in the art, it is not described further herein. It is noted that the lower seat 73 presents an axial end 75 that is sinusoidally shaped and sized to abut the lower axial side of the flapper member 64 in a flush, mating relation.

Figure 2A:
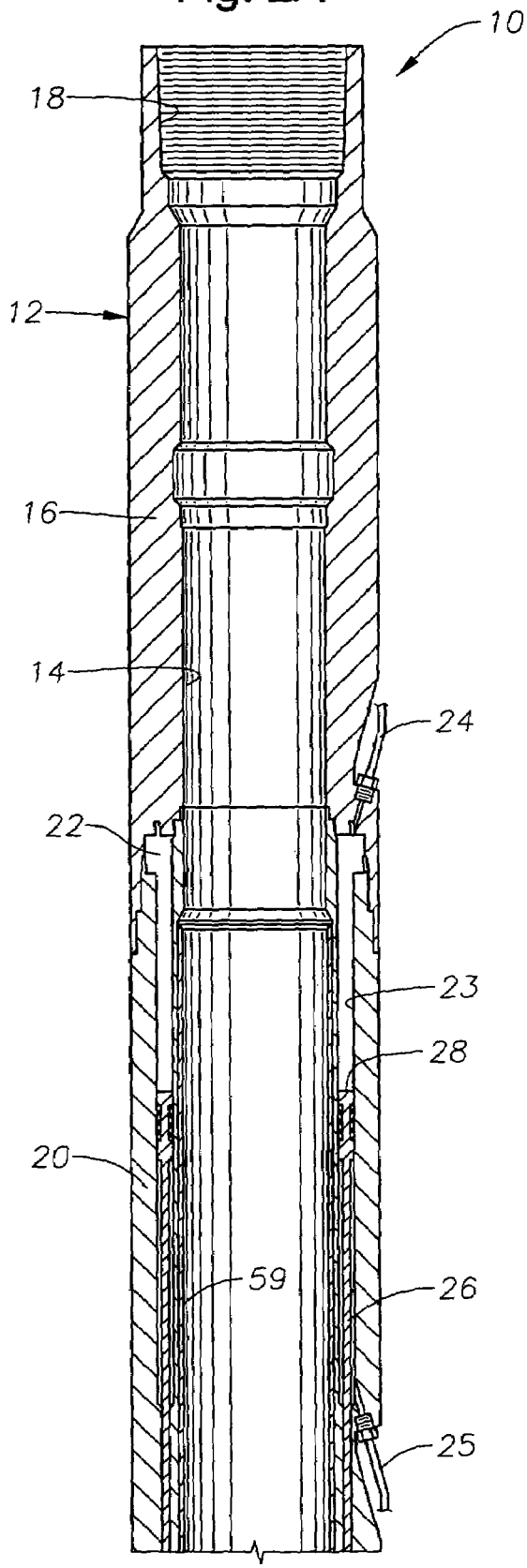
FIGS. 2A-2E present a side, cross-sectional view of the valve shown in FIGS 1A-1E, now with the lower flapper closed.
Figure 2B:
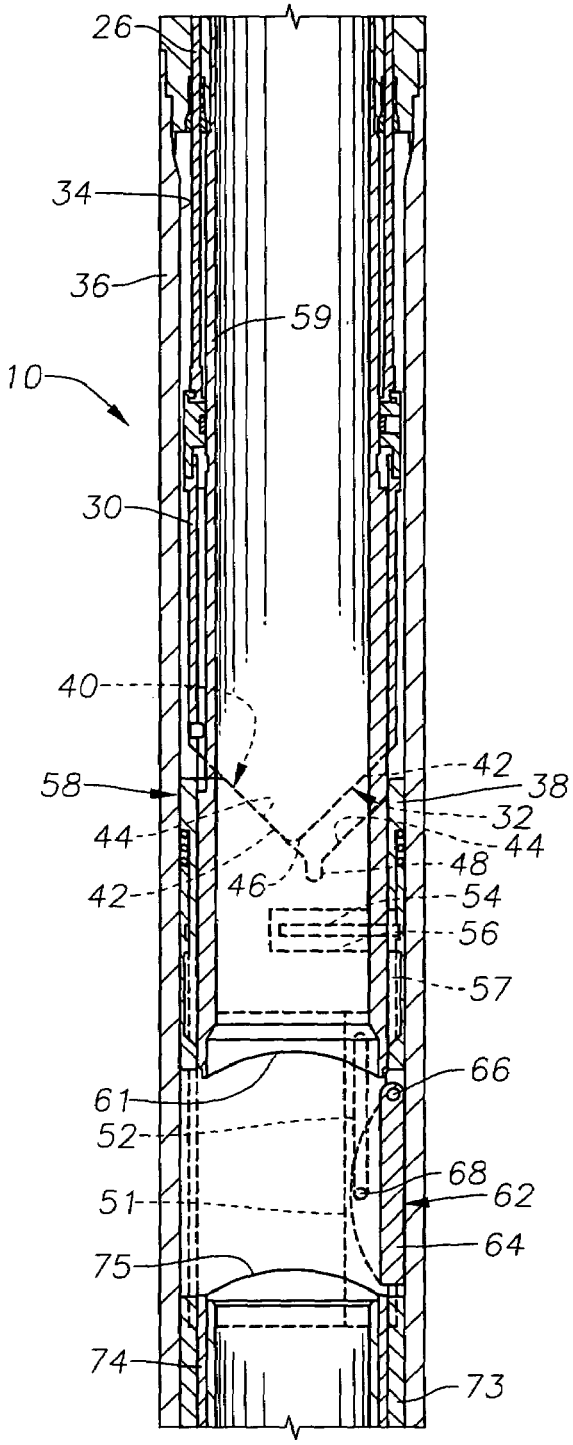
Figure 2C:
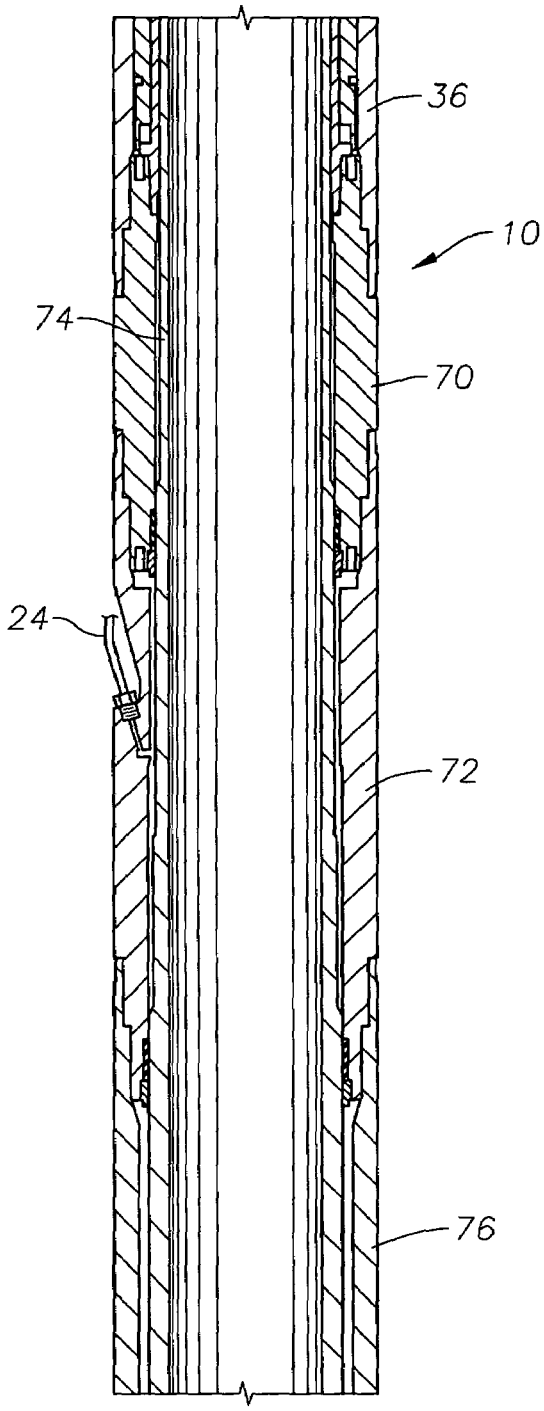
Figure 2D:
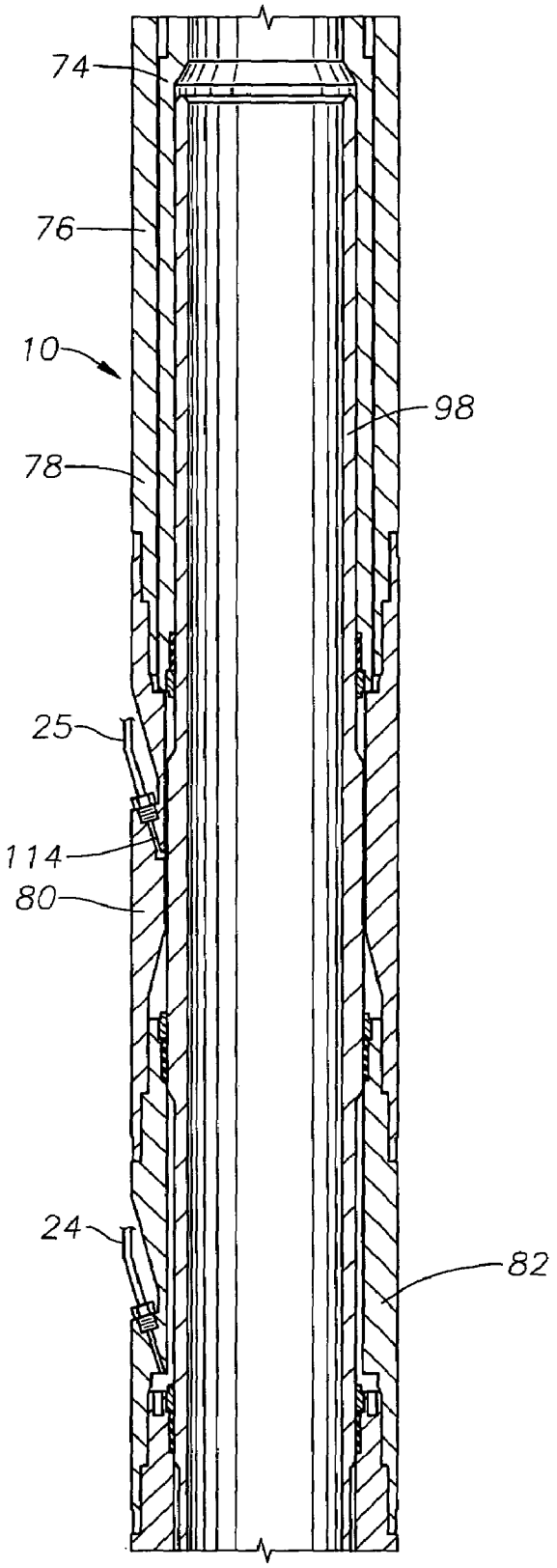
Figure 2E:
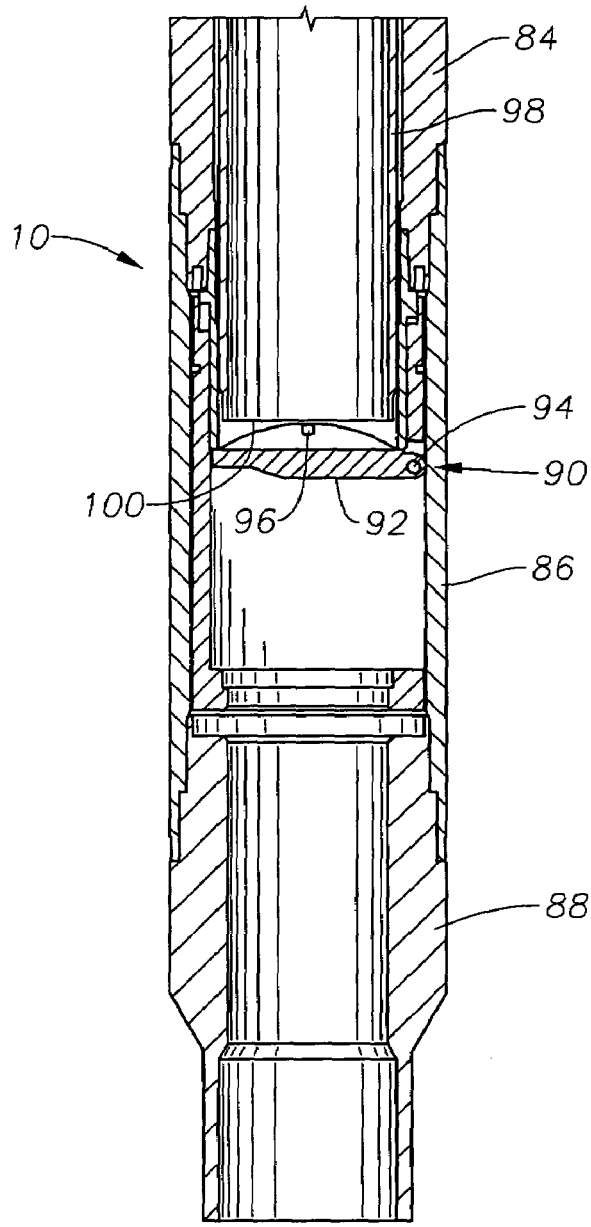

The lower end of the connector sub 72 is secured to sequentially interconnected housing subs 76, 80, 82, 84 and 86. The lower end 76 of sub 78 is secured to sub 80. The last of these, housing sub 86, is affixed to bottom sub 88. Housing sub 86 houses a lower flapper valve 90 having a flapper member 92 that is secured by hinge 94 to the housing sub 86. The lower flapper member 92 is opened and closed by pivoting movement about the hinge 94 between an open position (shown in FIG. 1E) and a closed position (shown in FIG. 2E) wherein wellbore fluid flow is blocked through the valve 90. As with conventional flapper valves, the flapper element 92 is spring-biased toward the closed position by a torsional spring associated with the hinge 94.

The flapper element 92 preferably includes an integrated pressure-relieving poppet valve 96, which may be of the type described in U.S. Pat. No. 6,644,408 entitled "Equalizing Flapper for Down Hole Safety Valves." U.S. Pat. No. 6,644,408 is owned by the assignee of the present invention and is herein incorporated by reference. The poppet valve 96 allows pressure to be relieved and substantially equalized across the flapper member 92 prior to opening the valve 90 by contact from a flow tube used to open the flapper valve 90.

Lower flow tube 98 is retained within the housing subs 78, 80, 82 and is axially moveable therein under the impetus of hydraulic fluid injected through hydraulic lines 24, as is known in the art. The lower flow tube 98 is used to selectively open and close the lower flapper valve 90 via contact with the flapper element 92 by the lower end 100 of the flow tube 98.

In operation, the lubricator valve 10 is moved through several configurations to conduct coordinated pressure testing of the production tubing string prior to passing a tool through the production tubing string and the lubricator valve 10. In the initial configuration, during or following run-in, the lubricator valve 10 is in the configuration depicted in FIGS. 1A-1E, with the upper and lower flapper valves 62, 90 both in an open position. This configuration allows fluids to pass through the lubricator valve 10 during run-in.

Next, the lubricator valve 10 is moved to the configuration shown in FIGS. 2A-2E with the lower flapper valve 90 closed. To accomplish this, the lower flow tube 98 is moved axially upwardly within the valve 10 to allow the torsion spring (not shown) of the lower flapper valve 90 to move the flapper element 92 to its closed position. With this accomplished, the lubricator valve 10 may be pressure tested from below the valve 10.

Figure 3A:
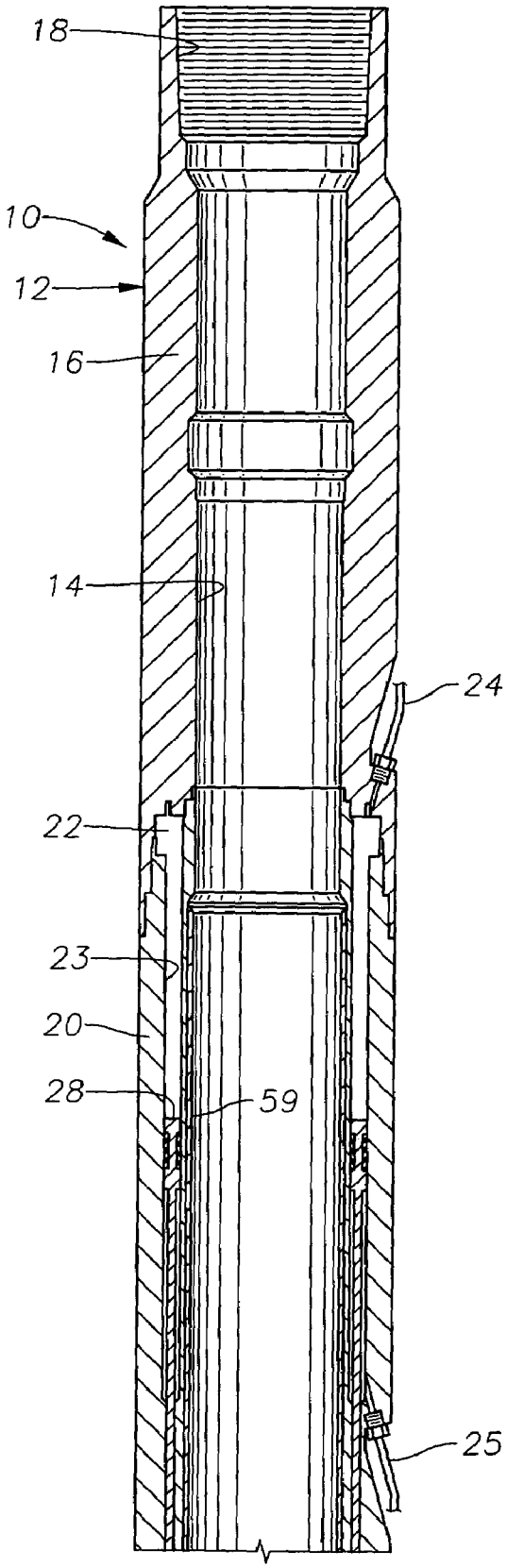
FIGS. 3A-3E are a side, cross-sectional view of the valve shown in FIGS 1A-1B now with the upper and lower flappers closed.
Figure 3B:
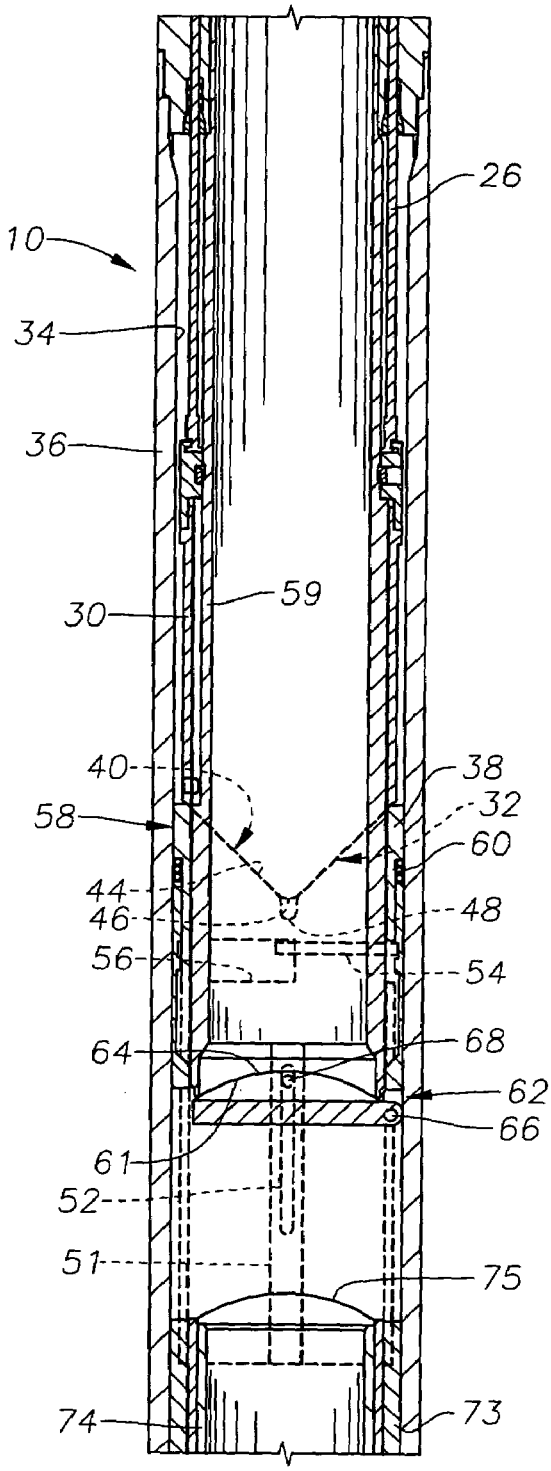
Figure 3C:
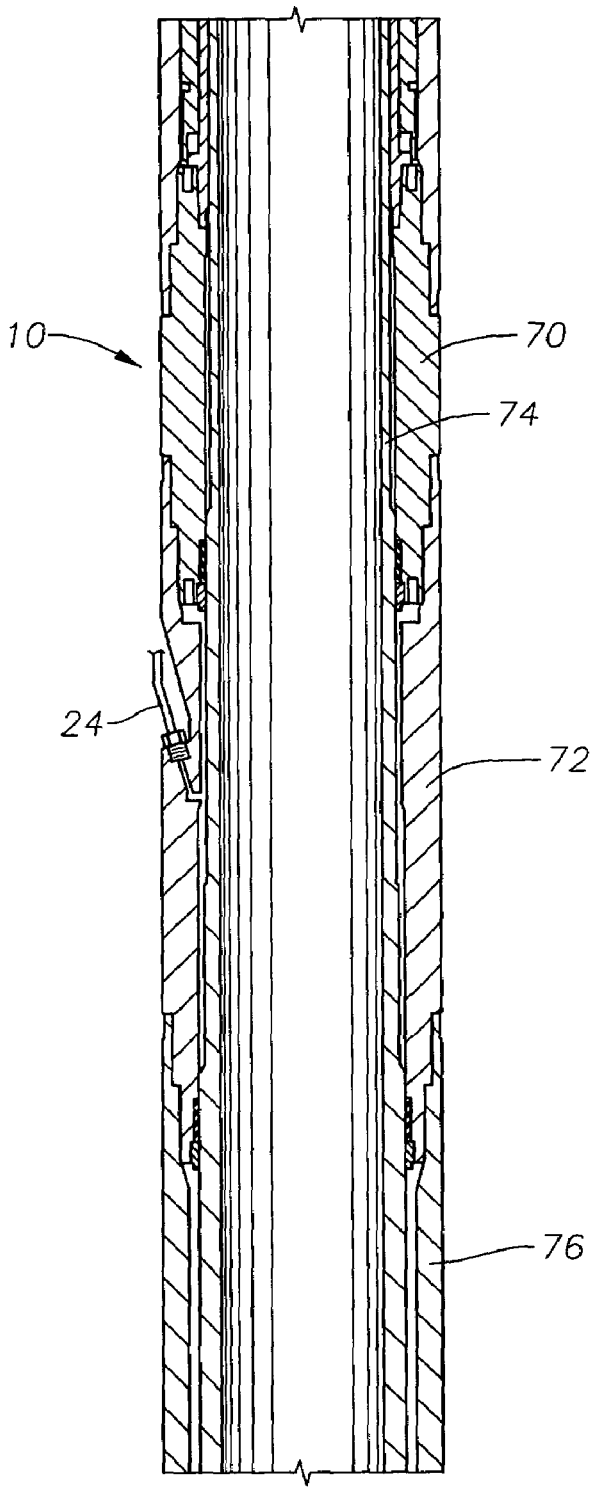
Figure 3D:
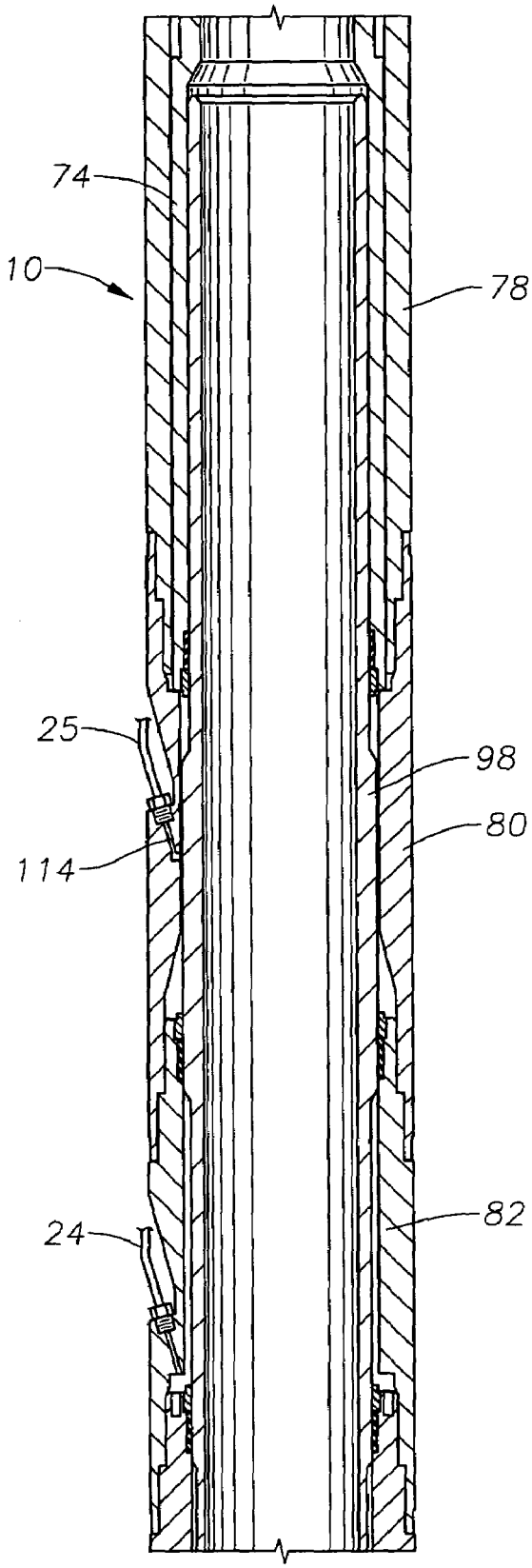
Figure 3E:
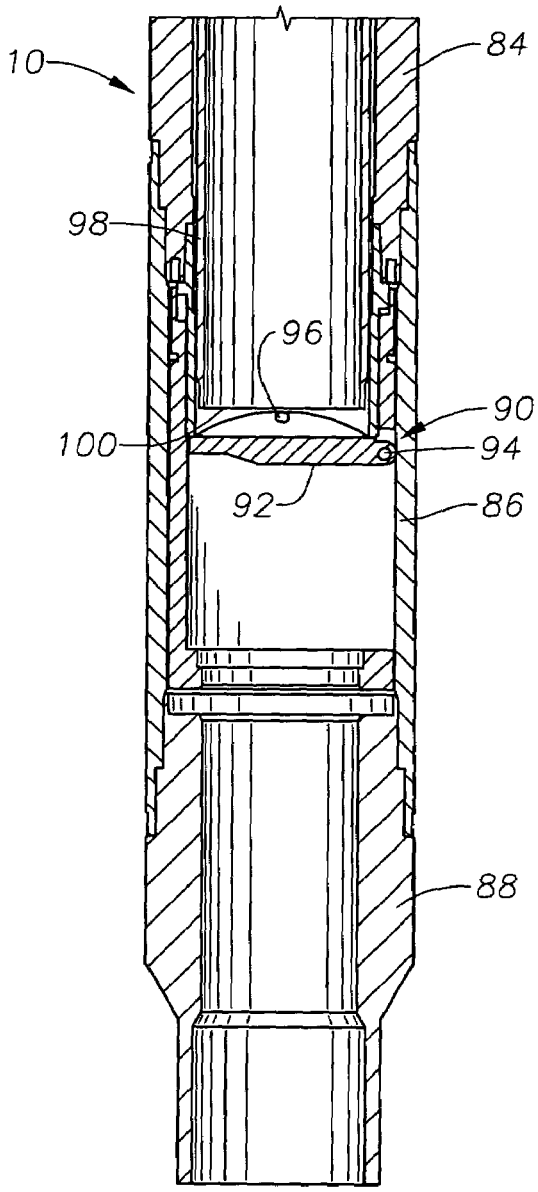
Figure 6:
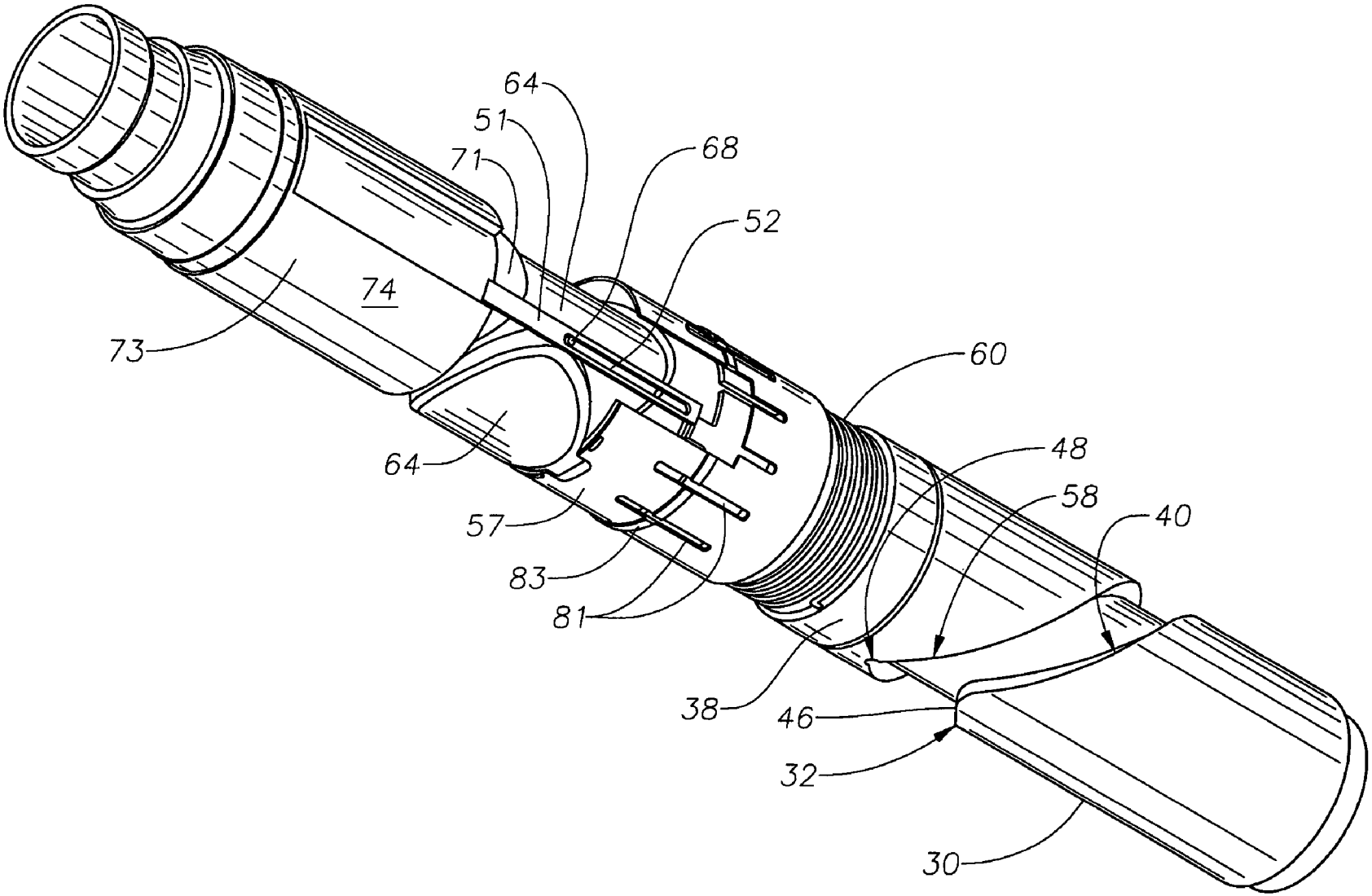
FIG. 6 is an external isometric view of the upper flapper valve portions of the lubricator valve with the upper flapper element in the open position.
Figure 7:
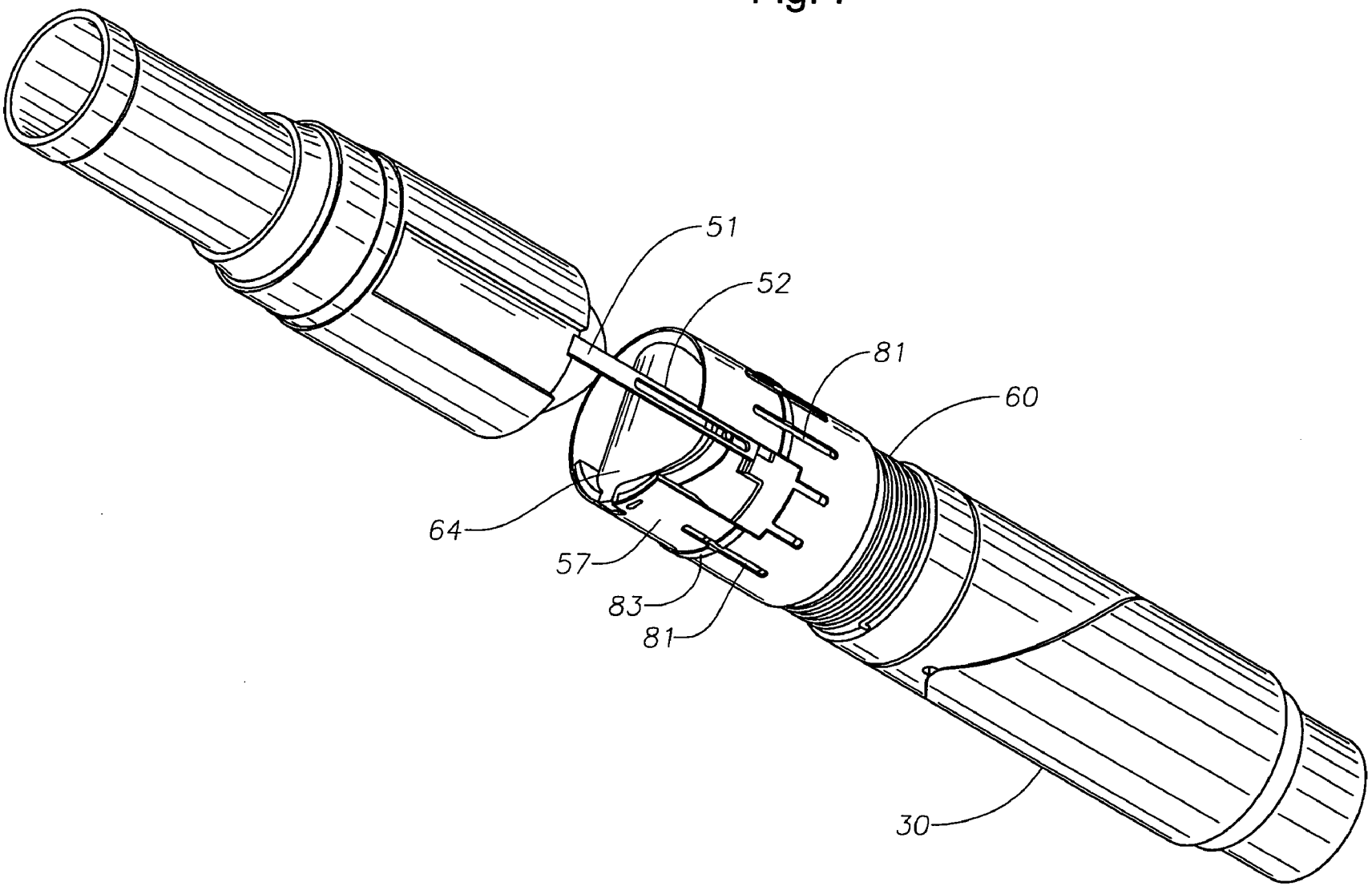
FIG. 7 is an external isometric view of the upper flapper valve portions of the lubricator valve shown in FIG. 6, now with the upper flapper element in a closed position.

FIGS. 3A-3E illustrate the valve 10 following the closure of the lower flapper valve 90. The upper flow tube 74 is moved axially downwardly with respect to the housing 12. Meanwhile, the lower flow tube 98 is moved axially upwardly with respect to the housing 12. The actuation sleeve 30 is moved axially downwardly by selective injection of hydraulic fluid through fluid conduits 24. The actuation sleeve 30 is rotationally locked with respect to the upper closure sleeve 59 so that the orientation profile 32 is unable to rotate within the valve 10. As depicted in FIGS. 3A-3E, the orientation profile 32 of the actuation sleeve 30 engages the engagement surface 40 of the orientation sleeve 38 to cam upon the engagement surface 40 and thereby rotate the orientation sleeve 38 so that the point 46 of the actuation sleeve 30 aligns with the point 48 of the orientation sleeve 38. When fully aligned, as shown in FIG. 3B, the lug 68 of the upper flapper element 64 will have traversed the slot 52 in the flip-flap arm 51 thereby allowing the flapper element 64 to move to its closed position to block wellbore fluid flow through the lubricator valve 10. FIGS. 6 and 7 help to illustrate this operation more clearly. It is noted that the closing of the upper flapper valve 62 is accomplished in a positive manner by the flip-flap arm 51 rather than merely relying upon the force of the torsion spring associated with the hinge 66 to close the flapper element 64. This is advantageous in the case that there is debris, scales, paraffin build-up or other problems associated with the valve 62 that might preclude a complete closing of the flapper member 64. The orientation feature also acts to prevent accidental closure of the flapper element 64 prematurely. Additionally it is noted that rotation of the orientation sleeve 38 in the opposite direction within the housing of the valve 10 will cause the flip-flap arm 51 to mechanically reopen the flapper member 64. The lug 68 of the flapper member 64 will traverse the slot 52 in the flip flap arm 51 in the opposite (i.e., downward) direction as the counter-rotation occurs.

Figure 4A:
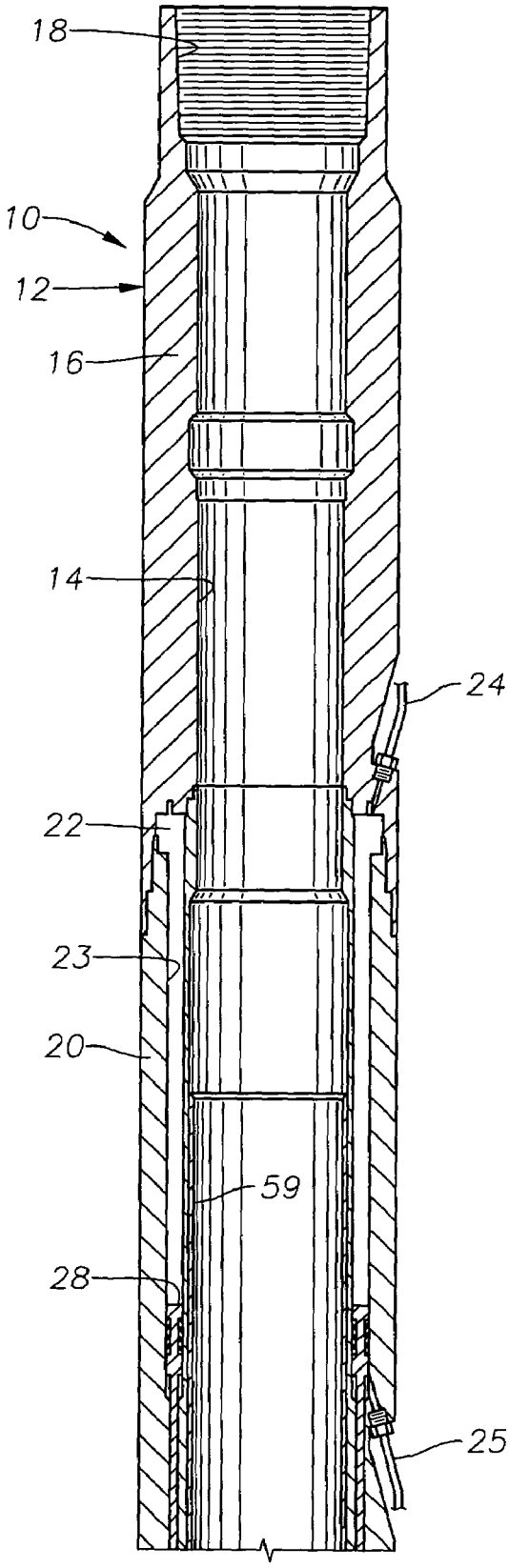
FIGS. 4A-4E are a side, cross-sectional view of the valve shown in FIGS 1A-1E with upper and lower flappers closed, and the upper flapper held closed.
Figure 4B:
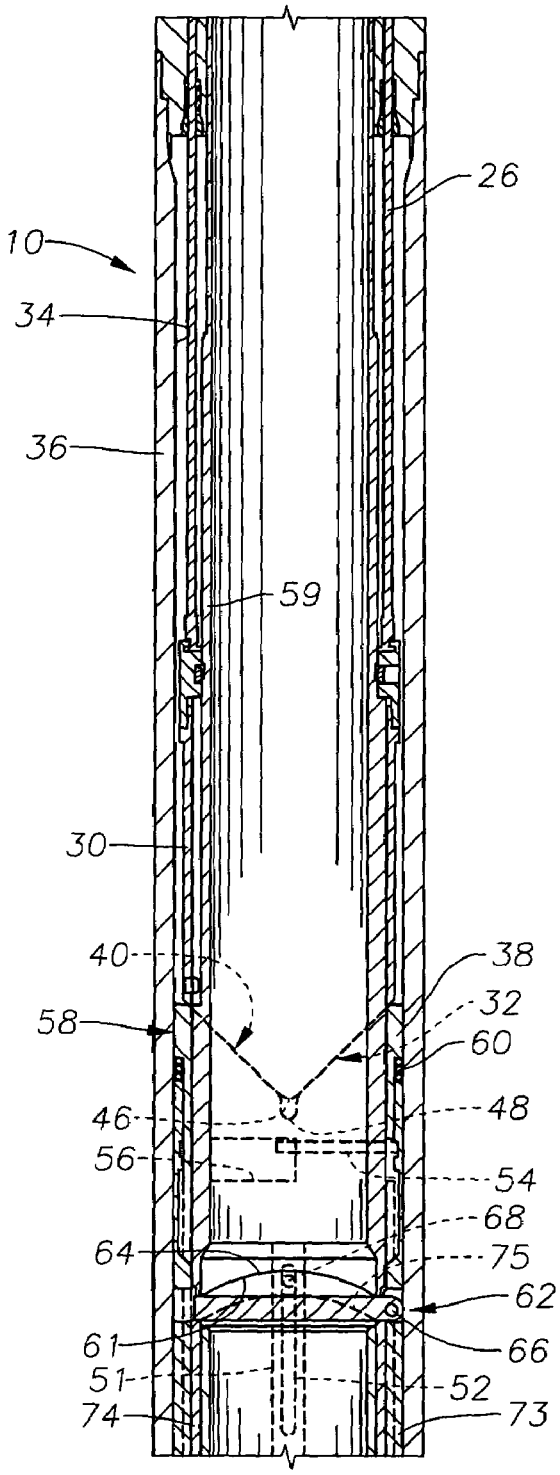
Figure 4C:
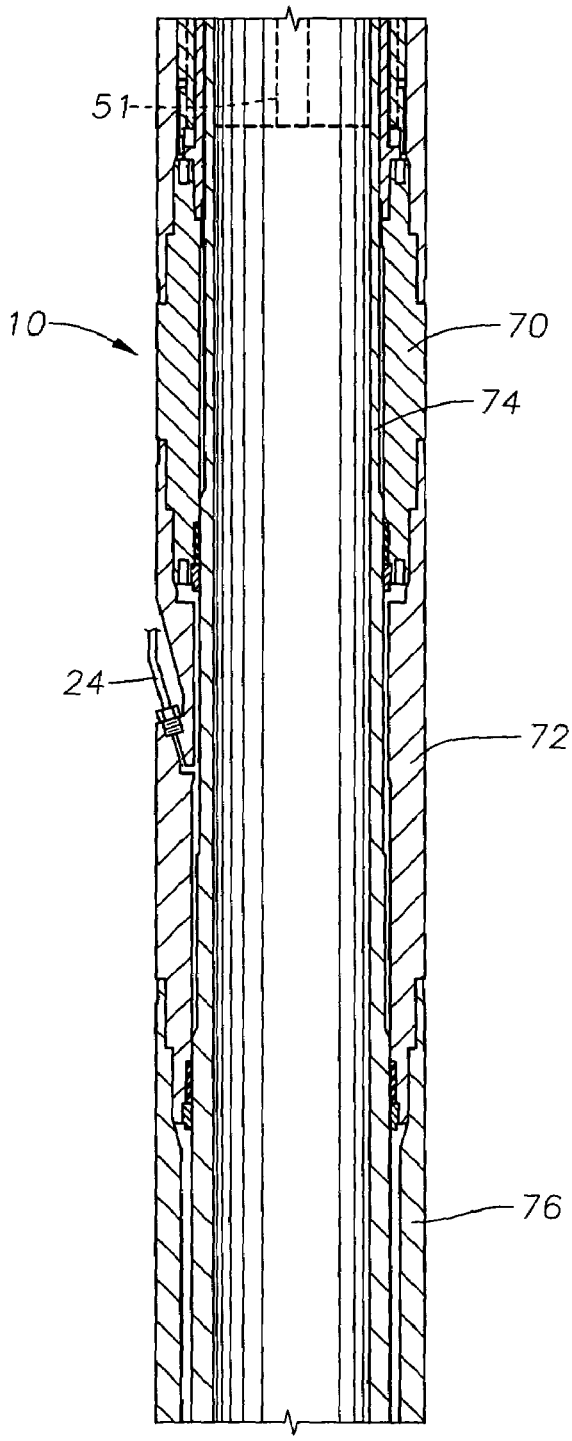
Figure 4D:
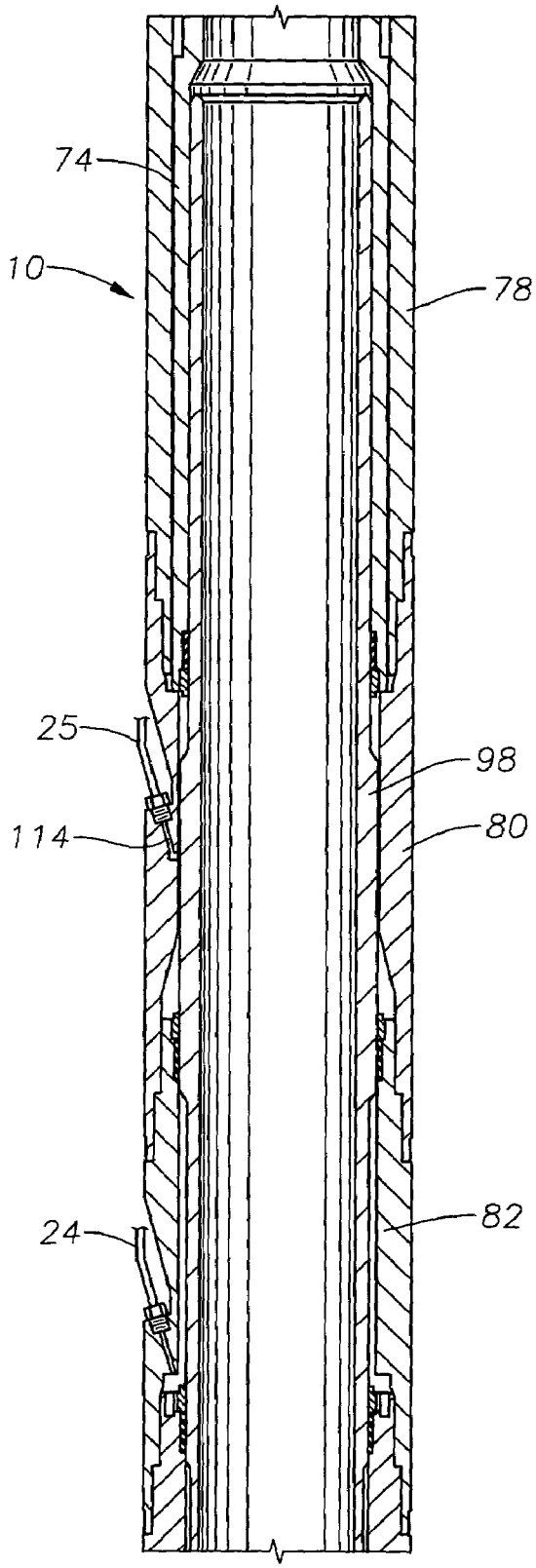
Figure 4E:
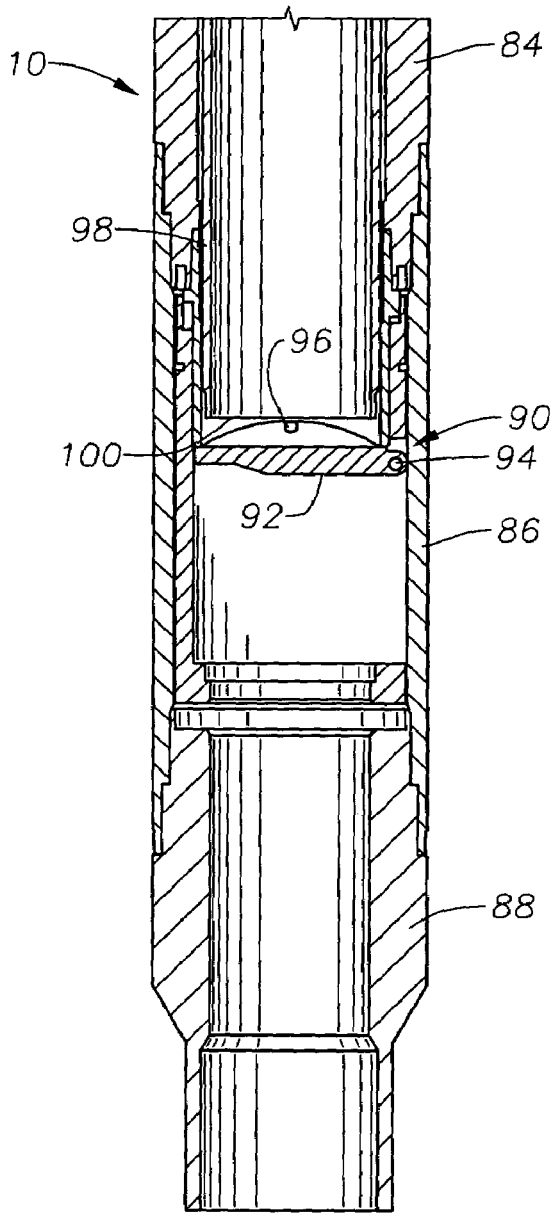

Next, the closure sleeve 59 is moved downwardly within the sleeve housing sub 36 to cause the axial end 61 to contact the upper axial side of the flapper member 64 in a flush, mating relation, as depicted in FIG. 3B. Also, the closure sleeve 59 is moved downwardly within the valve 10 to seat the closed upper flapper member 62/64 against the lower seat 73 (see FIG. 4B). At this point, the upper flapper member 64 is closed and secured in the closed configuration by being sandwiched between the closure sleeve 59 and the lower seat 73. This allows complete pressure testing of the upper flapper valve 62 from both above and below.

The lubricator valve 10 may be reopened to the position shown in FIGS 1A-1E, so that both flapper valves 62 and 90 are in an open position by selective injection of hydraulic fluid through hydraulic inlets 24. Via this selective injection, the closure sleeve 59 is moved axially upwardly and the upper flow tube 74 is moved axially upwardly within the valve 10.

It is desirable to utilize a time delay during reopening to ensure that the upper flapper valve member 64 is pulled upward and off the lower flapper seat and then re-opened before the upper flow tube 74 moves upwardly to protect the upper safety valve 62. A time delay device such as a Lee Visco jet 114 fitted to the lowermost control 'close' line 25 would delay the upward travel of the upper flow tube 74 so that the upper flapper member 64 is rotated to re-open and travel upwardly to move axially off of the lower seat 73 before the upper flow tube 74 moves axially upwardly. This delay prevents the upper flapper member 64 from being jammed in a partially open position by the upper flow tube 74. A manifold (not shown), of a type known in the art, could be used to operationally interconnect both of the close lines 24 while a separate manifold (not shown) could be used to operationally interconnect both of the open lines 25 of the valve 10. As explained previously, selective application of pressure within the open and close lines 24, 25 is used to open or close the valve 10. To re-open the valve 10, pressure equalization is preferably performed prior to reopening so that the pressure in lines 24 and 25 is substantially balanced. After pressure is equalized, the manifold associated with the lines 24 is opened to allow them to drain with a max pressure applied to close lines 25.

Hydraulic fluid injection will also urge flow tube 98 axially downwardly within the valve 10 so that the axial end 100 will contact the poppet valve 96 in the lower flapper member 92 and equalize the pressure across the flapper member 92. Additional downward movement of the flow tube 98 will cause the lower flapper member 92 to be moved to the open position shown in FIG. 1E.

Figure 5:
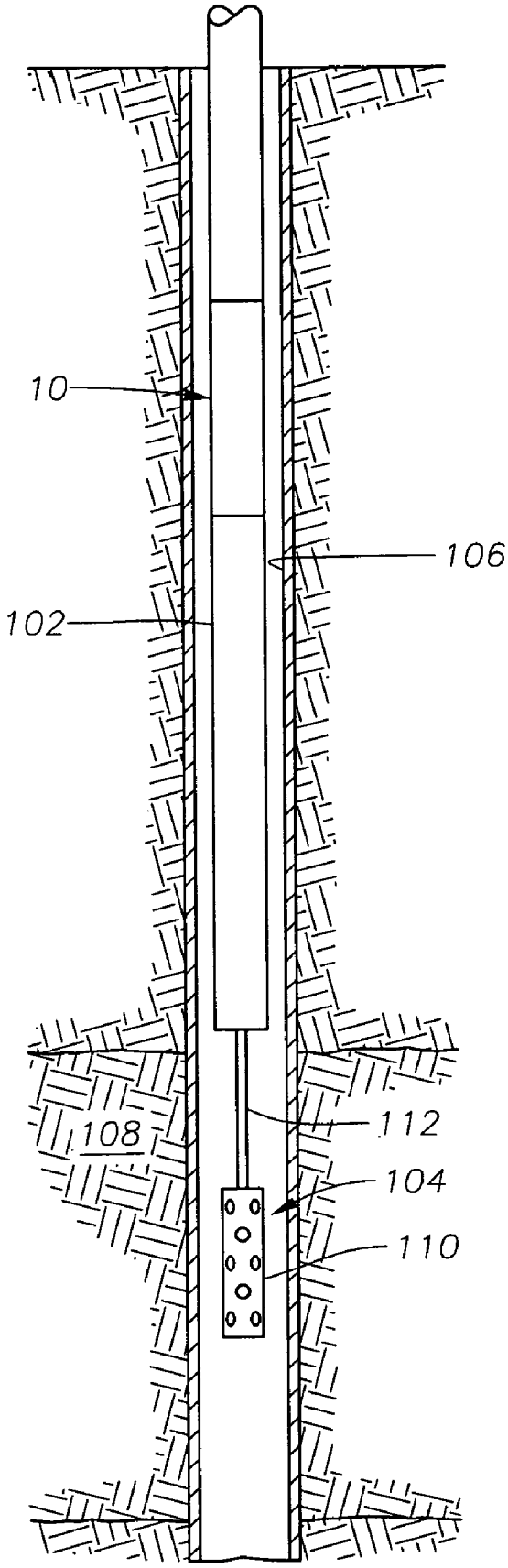
FIG. 5 is a side, cross-sectional view of an exemplary wellbore containing a production tubing string having incorporated therein a lubricator valve that is constructed in accordance with the present invention.

In operation within a wellbore, the lubricator valve 10 is disposed into a wellbore as an integrated portion of a production tubing string 102, as illustrated in FIG. 5. The lubricator valve 10 is located within the production tubing string 102 above an area of interest 104 within the surrounding wellbore 106 wherein it is desired to perform some function. One example of an area of interest 104 is proximate a production zone 108 below the production tubing string 102 wherein it is desired to create additional perforations within the wellbore 106 to enhance production flow. In this case, the lubricator valve 10 is operated as described above to test pressure above and below the lubricator valve 10 and then is fully opened (upper and lower flapper valves 62, 90 both opened) to allow a perforating gun 110 to be lowered through the production tubing string 102 on a wireline apparatus 112, of a type known in the art. Although a wireline running arrangement is depicted in FIG. 5, those of skill in the art will understand that other suitable running arrangements may be used as well, such as coiled tubing or tubing. Following perforation, the wireline apparatus 112 and perforating gun 110 are withdrawn from the production tubing string 102.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A lubricator valve for selectively closing off fluid flow within a production tubing string and for selectively passing a tool through the production tubing string, the lubricator valve comprising:

a valve housing to be incorporated into a production tubing string;

a first flapper valve within the housing having a first flapper member that is operable between open and closed positions to selectively close off fluid flow through the production tubing string;

a second flapper valve within the housing having a second flapper member that is operable between open and closed positions to selectively close off fluid flow through the production tubing string;

a flip-flap mechanism for selectively moving the first flapper member between the open and closed positions, the flip-flap mechanism comprising:

an orientation sleeve that is disposed within the housing and rotationally moveable therewith in; and a flip-flap arm member extending between the orientation sleeve and the first flapper member, the arm mechanically moving the first flapper member to the closed position upon rotation of the orientation sleeve in a first direction and mechanically opening the first flapper member upon rotation of the orientation sleeve in a second direction that is opposite the first direction.

2. The lubricator valve of claim 1 further comprising a tubular member that is axially moveable within the valve housing, the tubular member having a shaped end to abut an axial side of the first flapper member in a flush, mating relation.

3. The lubricator valve of claim 1 wherein the second flapper member includes a pressure-equalizing valve for equalizing pressure across the second flapper member prior to moving said second flapper member to the open position.

4. The lubricator valve if claim 3 wherein the pressure-equalizing valve comprises a poppet-style valve that is actuated to equalize pressure across the second flapper member upon contact by an axial end of a flow tube.

5. The lubricator valve of claim 1 wherein the orientation sleeve is rotated with respect to the valve housing by contacting a shaped engagement surface on the orientation sleeve and camming the engagement surface to rotate the orientation sleeve.

6. The lubricator valve of claim 1 wherein the first and second flapper members are each secured to the valve housing by a hinge, and each of the flapper members is moved from a closed to an open position by pivoting the flapper member downwardly away from a closure seat so that debris atop the flapper member will not block opening of the flapper member.

7. The lubricator valve of claim 1 further comprising:

a closing sleeve that is axially moveable with respect to the valve housing and having a shaped axial end to be selectively brought into flush, mating contact with a first axial side of the first flapper member upon axial movement of the closing sleeve with respect to the valve housing; and a flow tube that is axially moveable with respect to the valve housing and having a shaped axial end to be selectively brought into flush, mating contact with a second axial side of the first flapper member upon axial movement of the flow tube with respect to the valve housing.

8. A system for conducting a downhole operation from the surface into production tubing string of a live well, the system comprising:

a) a lubricator valve for selectively closing off fluid flow within a production tubing string and for selectively passing a tool through a production tubing string, the valve comprising:

a valve housing defining an axial bore for passage of fluid and tool through the valve housing;

first and second flapper valves within the valve housing, each of the first and second flapper valves having valve seats and flapper members that are selectively moveable between a closed position, wherein the flapper member is seated upon the valve seat, and an open position, wherein the flapper member is pivoted away from the valve seat;

a closing sleeve that is axially moveable with respect to the valve housing and having a shaped axial end to be selectively brought into flush, mating contact with a first axial side of the first flapper member upon axial movement of the closing sleeve with respect to the valve housing;

a flow tube that is axially moveable with respect to the valve housing and having a shaped axial end to be selectively brought into flush, mating contact with a second axial side of the first flapper member upon axial movement of the flow tube with respect to the valve housing;

at least one of the first and second flapper members being moved to an open position by pivoting of the flapper member downwardly and away from the valve seat; and b) a downhole tool for conducting an operation within the well, the tool being shaped and sized to pass axially through the lubricator valve.

9. The system of claim 8 wherein both of the first and second flapper members are moved to an open position by pivoting of the flapper member downwardly and away from the valve seat.

10. The system of claim 8 wherein the downhole tool is a perforating gun.

11. The system of claim 8 wherein at least one flapper member incorporates an equalization valve for equalizing pressure across the flapper member prior to moving the flapper member to an open position, the equalization valve being actuated to equalize pressure by contact from an axially moveable tube within the lubrication valve.

12. The system of claim 8 further comprising a flip-flap mechanism for selectively moving the first flapper member between the open and closed positions, the flip-flap mechanism comprising:

an orientation sleeve that is disposed within the housing and rotationally moveable therewithin; and a flip-flap arm member extending between the orientation sleeve and the first flapper member, the arm mechanically moving the first flapper member to the closed position upon rotation of the orientation sleeve in a first direction and mechanically opening the first flapper member upon rotation of the orientation sleeve in a second direction that is opposite the first direction.

13. The system of claim 12 wherein the orientation sleeve is rotated with respect to the valve housing by contacting a shaped engagement surface on the orientation sleeve and camming the engagement surface to rotate the orientation sleeve.

14. A method for conducting a downhole operation from the surface into a production tubing string of a live well, the method comprising the steps of:

Installing a lubricator valve within a production tubing string, the lubricator valve having first and second flapper valves that are independently operable between open and closed positions to selectively block passage or fluid or tools through the lubricator valve;

disposing the production tubing string within a wellbore with the first and second flapper valves in the open positions;

closing at least one of the first and second flapper valves by:

engaging a lug on the first flapper member with a flip-flap arm member having a slot therein for receiving the lug; and moving the lug along the slot to cause the first flapper member to move from an open to a closed position;

pressure testing the lubricator valve from at least one axial direction;

opening both of said first and second flapper valves; and disposing a downhole tool through the production tubing string and the lubricator valve to a point below the lubricator valve.

15. The method of claim 14 wherein the step of pressure testing the lubricator valve comprises alternately increasing pressure at two axial ends of the lubricator valve.

16. The method of claim 14 wherein the step of closing at least one of the first and second flapper valves further comprises rotating an orientation sleeve within the valve housing to cause the lug to move along the slot.

17. The method of claim 14 wherein the step of closing at least one of the first and second flapper valves further comprises:

closing the first flapper member; and urging shaped end portions into flush, mating contact with both upper and lower axial sides of the first flapper member to retain the first flapper member in the closed position.

18. The method of claim 17 wherein the shaped end portions are brought into contact with the upper and lower axial sides of the first flapper member by axially urging flow tube members within the lubricator valve using hydraulic fluid injection.

* * * * *